US011035543B2

(12) United States Patent
Toyoshima et al.

(10) Patent No.: US 11,035,543 B2
(45) Date of Patent: Jun. 15, 2021

(54) LAMP UNIT

(71) Applicant: KOITO MANUFACTURING CO., LTD., Tokyo (JP)

(72) Inventors: Takanobu Toyoshima, Shizuoka (JP); Yusuke Nakada, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 17/018,093

(22) Filed: Sep. 11, 2020

(65) Prior Publication Data

US 2020/0408378 A1 Dec. 31, 2020

Related U.S. Application Data

(63) Continuation of application No. PCT/JP2019/009780, filed on Mar. 11, 2019.

(30) Foreign Application Priority Data

Mar. 14, 2018 (JP) ..... JP2018-046662

(51) Int. Cl.
*F21S 41/675* (2018.01)
*F21S 41/33* (2018.01)
(Continued)

(52) U.S. Cl.
CPC ..... *F21S 41/675* (2018.01); *F21S 41/25* (2018.01); *F21S 41/33* (2018.01); *F21S 41/141* (2018.01)

(58) Field of Classification Search
None
See application file for complete search history.

(56) References Cited

U.S. PATENT DOCUMENTS

2017/0210278 A1* 7/2017 Matsuno ..... B60Q 1/122
2017/0282785 A1 10/2017 Albou et al.
2018/0156414 A1* 6/2018 Hoshino ..... F21S 41/14

FOREIGN PATENT DOCUMENTS

JP 2014216087 A 11/2014
JP 2015174551 A 10/2015
(Continued)

OTHER PUBLICATIONS

International Search Report (PCT/ISA/210) dated May 28, 2019 issued by the Japan Patent Office in corresponding PCT Application No. PCT/JP2019/009780, with English translation (4 pages).
(Continued)

*Primary Examiner* — Elmito Breval
(74) *Attorney, Agent, or Firm* — Buchanan Ingersoll & Rooney PC

(57) ABSTRACT

A lamp unit includes: a projective optical system; a light deflector that is provided behind the projective optical system and selectively reflects incident light toward the projective optical system; a first irradiating optical system that irradiates a reflecting part of the light deflector with first light; and a second irradiating optical system that irradiates the reflecting part of the light deflector with second light. The first irradiating optical system and the second irradiating optical system are arranged such that a direction of irradiation by the first light and a direction of irradiation by the second light are not parallel when a front of the reflecting part is viewed.

7 Claims, 10 Drawing Sheets

(51) Int. Cl.
*F21S 41/25* (2018.01)
*F21S 41/141* (2018.01)

(56) References Cited

FOREIGN PATENT DOCUMENTS

| | | | |
|---|---|---|---|
| JP | 2016110760 | A | 6/2016 |
| JP | 2017204460 | A | 11/2017 |
| WO | 2015033764 | A1 | 3/2015 |
| WO | 2018021109 | A1 | 2/2018 |

OTHER PUBLICATIONS

Written Opinion (PCT/ISA/237) dated May 28, 2019 issued issued by the Japan Patent Office in corresponding PCT Application No. PCT/JP2019/009780, with English translation (13 pages).

* cited by examiner

10

LAMP UNIT

CROSS-REFERENCE TO RELATED APPLICATIONS

This application is based upon and claims the benefit of priority from the prior Japanese Patent Application No. 2018-046662, filed on Mar. 14, 2018 and International Patent Application No. PCT/JP2019/009780, filed on Mar. 11, 2019, the entire content of each of which is incorporated herein by reference.

BACKGROUND OF THE INVENTION

1. Field of the Invention

The present invention relates to a lamp unit.

2. Description of the Related Art

Vehicle lamp units adapted to irradiate a scenery in front of a vehicle with a predetermined light distribution pattern by selectively reflecting light output from a light source, using a reflecting device provided on its surface with a plurality of reflective elements arranged in a matrix to (patent document 1). A large number of reflective elements are arranged in a tiltable manner in the reflective device. It is possible to switch the position of the large number of reflective elements between the first position and the second position. The reflecting device is configured to form a light distribution pattern for illuminating the road surface, etc. by appropriately changing the position of each reflective element to the first position at which the direction of reflection of the light from the light source contributes to the formation of a light distribution pattern or to the second position at which the direction of reflection does not contribute to the formation of a light distribution pattern.

[Patent Literature] JP2016-110760

The aforementioned lamp unit is configured to form a desired light distribution pattern in a space in front of the vehicle by selectively reflecting light output from a single light source. Therefore, the elements of the lamp unit are arranged to adapt to a single light source. Accordingly, the elements of the lamp unit are not optimally arranged in the case a plurality of light sources are employed.

SUMMARY OF THE INVENTION

The present invention addresses the above-described issue, and an illustrative purpose thereof is to provide a novel lamp unit capable of using light output from a plurality of irradiating optical systems efficiently.

A lamp unit according to an embodiment of the present invention includes: a projective optical system; a light deflector that is provided behind the projective optical system and selectively reflects incident light toward the projective optical system; a first irradiating optical system that irradiates a reflecting part of the light deflector with first light; and a second irradiating optical system that irradiates the reflecting part of the light deflector with second light. The first irradiating optical system and the second irradiating optical system are arranged such that a direction of irradiation by the first light and a direction of irradiation by the second light are not parallel when a front of the reflecting part is viewed.

BRIEF DESCRIPTION OF THE DRAWINGS

Embodiments will now be described, by way of example only, with reference to the accompanying drawings that are meant to be exemplary, not limiting, and wherein like elements are numbered alike in several figures, in which.

DETAILED DESCRIPTION OF THE INVENTION

Figure 1:
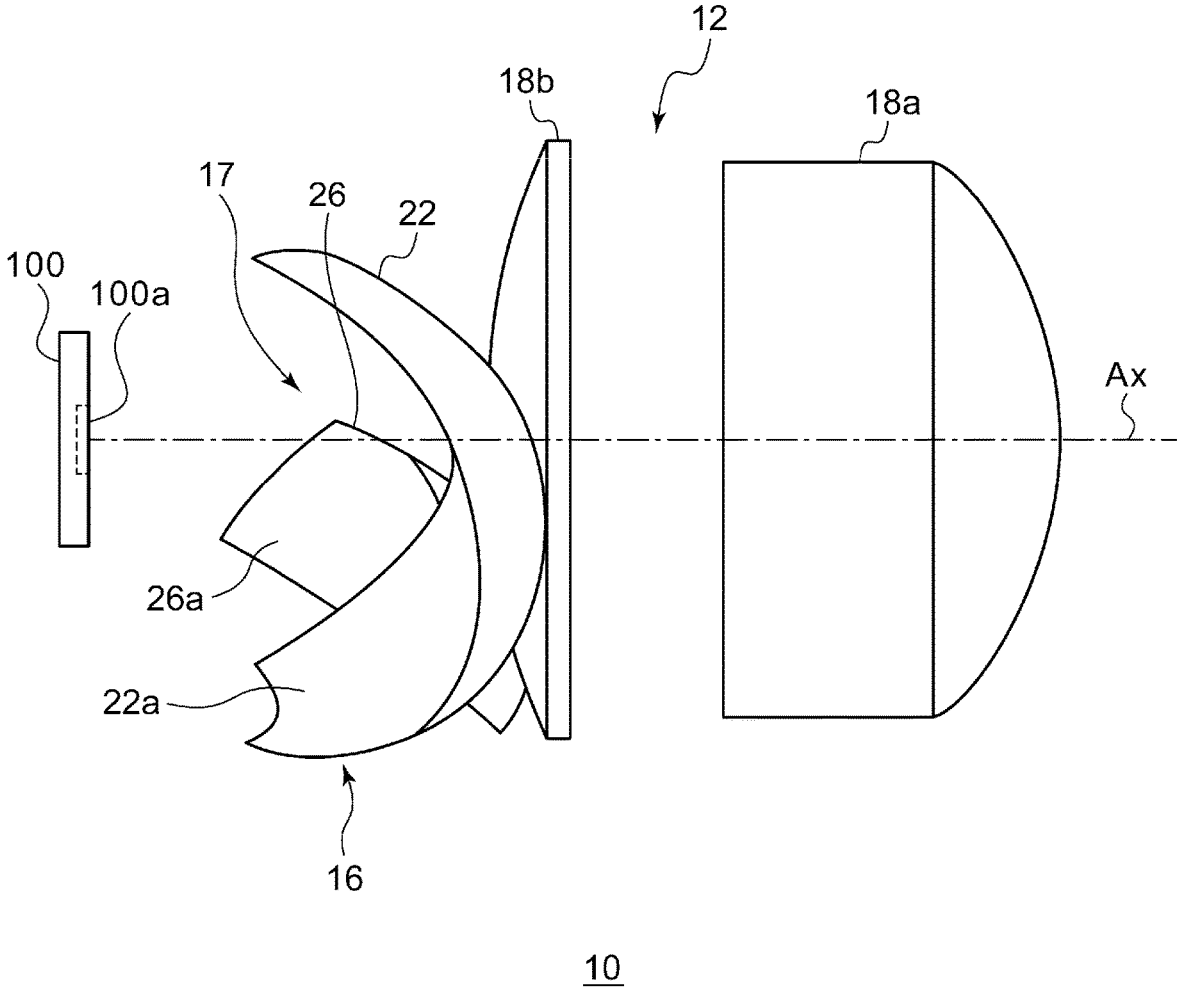
FIG. 1 is a side view schematically showing a general configuration of the lamp unit according to the embodiment.

Hereinafter, the invention will be described based on preferred embodiments with reference to the accompanying drawings. Identical or like constituting elements, members, processes shown in the drawings are represented by identical symbols and a duplicate description will be omitted. The embodiments do not intend to limit the scope of the invention but exemplify the invention. Not all of the features and the combinations thereof described in the embodiments are necessarily essential to the invention.

A lamp unit according to an embodiment of the present invention includes: a projective optical system; a light deflector that is provided behind the projective optical system and selectively reflects incident light toward the projective optical system; a first irradiating optical system that irradiates a reflecting part of the light deflector with first light; and a second irradiating optical system that irradiates the reflecting part of the light deflector with second light. The first irradiating optical system and the second irradiating optical system are arranged such that a direction of irradiation by the first light and a direction of irradiation by the second light are not parallel when a front of the reflecting part is viewed.

This inhibits the first light that is not reflected toward the projective optical system when the first light radiated by the first irradiating optical system is reflected by the light deflector from interfering with the second irradiating optical system. Similarly, the second light that is not reflected toward the projective optical system when the second light radiated by the second irradiating optical system is reflected by the light deflector is inhibited from interfering with the first irradiating optical system. This increases the flexibility of arrangement and configuration of the irradiating optical systems and makes it possible to use more of the light radiated by the respective irradiating optical systems in the projective optical system.

The light deflector may be configured such that at least a partial region of the reflecting part is adapted to be switched, around a pivot shaft, between i) a first reflecting position that reflects light radiated by the first irradiating optical system or the second irradiating optical system toward the projective optical system such that reflected light is effectively used as part of a light distribution pattern and ii) a second reflecting position that reflects light radiated by the first irradiating optical system or the second irradiating optical system such that reflected light is not effectively used, the first irradiating optical system may be provided on one side of the pivot shaft when a front of the reflecting part is viewed, and the second irradiating optical system may be provided on the other side of the pivot shaft when the front of the reflecting part is viewed. Since the first irradiating optical system and the second irradiating optical system can be provided on both sides of the light deflector, the incidence direction of the light traveling toward the reflecting part of the light deflector can be properly set without considering the interference between the irradiating optical systems.

The first irradiating optical system may be arranged to irradiate the reflecting part diagonally with the first light when the front of the reflecting part is viewed, and the second irradiating optical system may be arranged to irradiate the reflecting part diagonally with the second light when the front of the reflecting part is viewed. This can reduce the width of the lamp unit.

The light deflector may include a micromirror array. This allows light distribution patterns of various shapes to be formed promptly and accurately.

The projective optical system may include a projection lens. The light deflector may be configured such that the first light and the second light reflected at the second reflecting position are not incident on the projection lens. This inhibits occurrence of stray light.

Optional combinations of the aforementioned constituting elements, and implementations of the invention in the form of methods, apparatuses, and systems may also be practiced as additional modes of the present invention.

[Lamp Unit]

Figure 2:
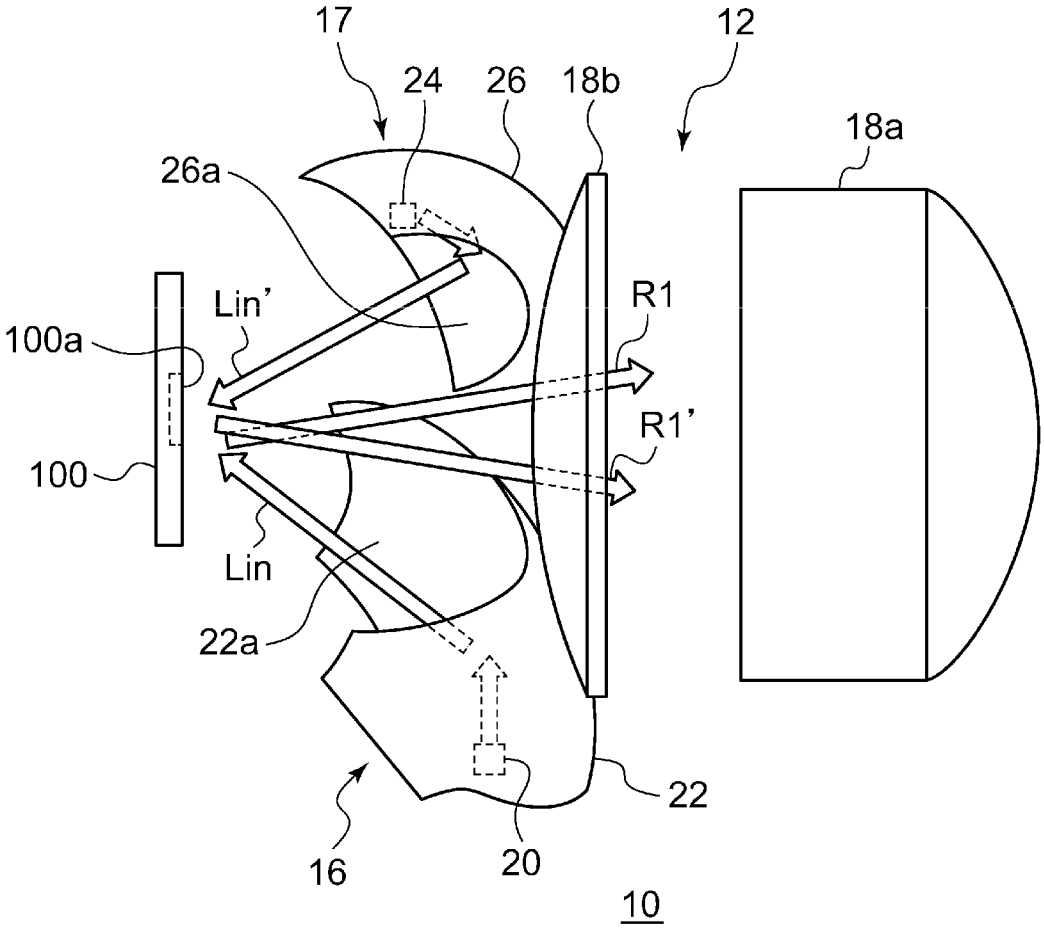
FIG. 2 is a top view schematically showing a general configuration of the lamp unit according to the embodiment.
Figure 3:
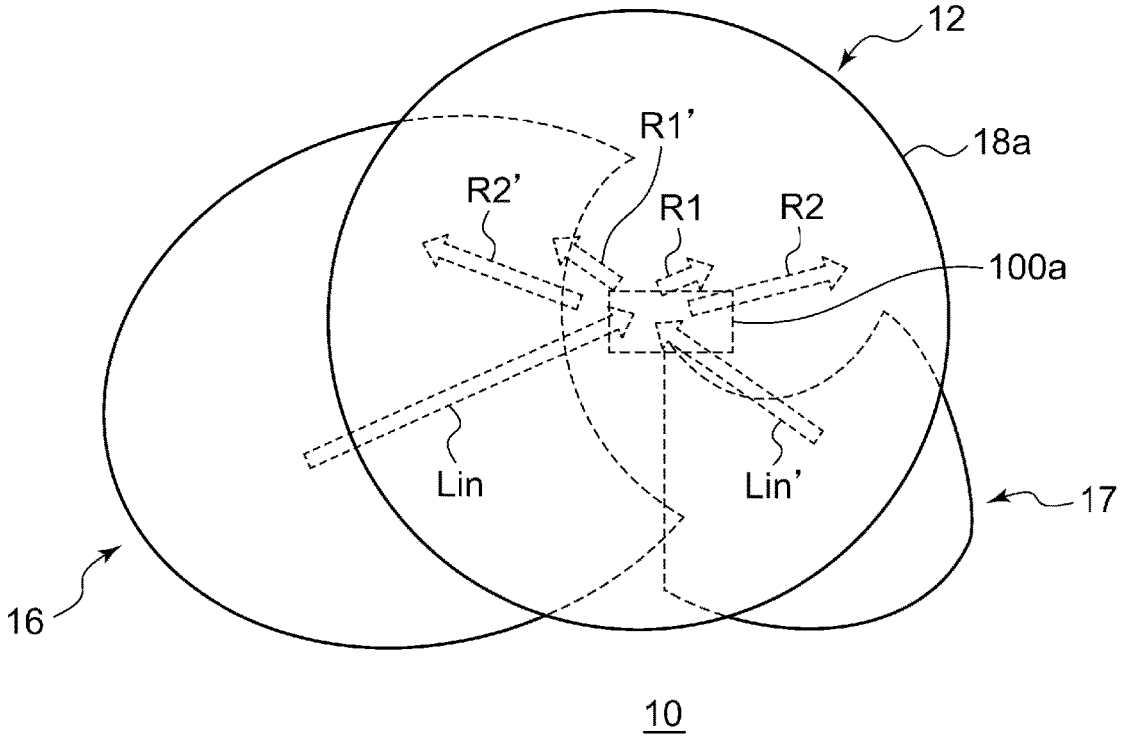
FIG. 3 is a front view schematically showing a general configuration of the lamp unit according to the embodiment.
Figure 4:
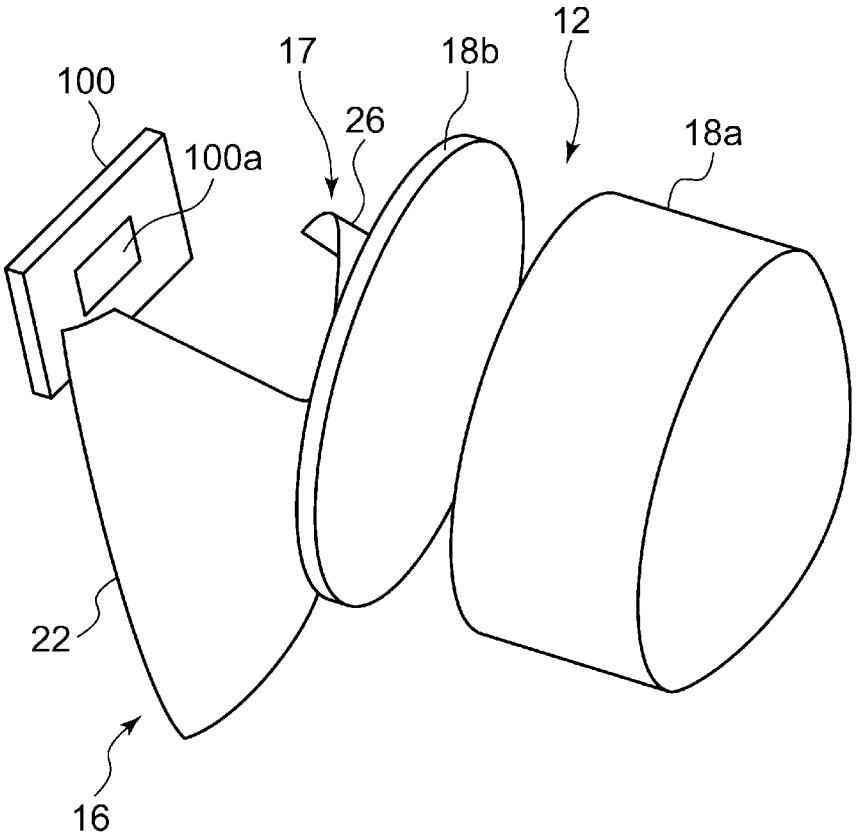
FIG. 4 is a perspective view schematically showing a general configuration of the lamp unit according to the embodiment.

FIG. 1 is a side view schematically showing a general configuration of the lamp unit according to the embodiment. FIG. 2 is a top view schematically showing a general configuration of the lamp unit according to the embodiment. FIG. 3 is a front view schematically showing a general configuration of the lamp unit according to the embodiment. FIG. 4 is a perspective view schematically showing a general configuration of the lamp unit according to the embodiment.

The lamp unit 10 according to the embodiment includes a projective optical system 12, a light deflector 100 provided behind the projective optical system 12 and on a light axis Ax and selectively reflecting incident light to the projective optical system 12, and a first irradiating optical system 16 and a second irradiating optical system 17 for irradiating a reflecting part 100*a* of the light deflector 100 with the light. The projective optical system 12 includes a first projection lens 18*a* and a second projection lens 18*b*. The irradiating optical system 16 includes a light source 20 and a reflector 22. The irradiating optical system 17 includes a light source 24 and a reflector 26.

The lamp unit 10 according to the embodiment is main used as a vehicle lamp (e.g., vehicle head lamp). The application is not limited to this, and the embodiment is also applicable to lamps in illuminating devices and mobile objects (airplanes, rail cars).

A semiconductor light emitting device such as a light emitting diode (LED), a laser diode (LD), and an electroluminescence (EL) device, etc., an electric bulb, an incandescent lamp (halogen lamp), a discharge lamp, or the like may be used as the light source 20 and the light source 24. A light condensing member may be provided between the light source and the reflector. The light condensing member is configured to guide much of the light output from the light source to the reflecting surface of the reflector. For example, a convex lens, a solid shell-shaped light guide, a reflecting mirror having a reflecting inner surface, etc. is used. More specifically, the light condensing member may be a compound parabolic concentrator. In the case most of the light output from the light source can be guided to the reflecting surface of the reflector, the light condensing member need not be used. For example, the light source is mounted at a predetermined position of a heat sink made of a metal, a ceramic, etc.

The light deflector 100 is provided on the light axis X of the projective optical system 12 and is configured to selectively reflect the light output from the light source 20 and the light source 24 to the projective optical system 12. For example, the light deflector 100 is an arrangement of a plurality of micromirrors in an array (matrix) such as a micro electro-mechanical system (MEMS) and a digital mirror device (DMD). By controlling the angle of the reflecting surface of each of the plurality of these micromirrors, the direction of reflection of the light output from the light source 20 and the light source 24 can be selectively changed. In other words, the light deflector 100 can reflect a portion of the light output from the light source 20 and the light source 24 toward the projective optical system 12 and reflect the other portion of the light in a direction in which the light is not effectively used. The direction in which the light is not effectively used can be understood as a direction in which the impact of reflected light is small (e.g., the direction in which the reflected light contributes little to the formation of a desired light distribution pattern) or the direction in which the reflected light travels toward a light absorbing member (light shielding member).

The micromirror array of the light deflector 100 described later is arranged in the neighborhood of the composite focal point of the first projection lens 18*a* and the second projection lens 18*b* of the projective optical system 12 according to the embodiment. The projective optical system 12 may include one optical member such as a lens or three or more optical members. The optical member included in the projective optical system is not limited to a lens and may be a reflecting member.

The first irradiating optical system 16 according to the embodiment includes a reflector 22 that reflects the light output from the light source 20 toward the light deflector 100. The reflector 22 is configured to focus the reflected light on the reflecting part 100*a* of the light deflector 100. This allows the light output from the light source 20 to travel toward the reflecting part 100*a* of the light deflector 100 efficiently.

Similarly, the second irradiating optical system 17 according to the embodiment includes a reflector 26 that reflects the light output from the light source 24 toward the light deflector 100. The reflector 26 is configured to focus the reflected light toward the reflecting part 100*a* of the light deflector 100. This allows the light output from the light source 24 to travel toward the reflecting part 100*a* of the light deflector 100 efficiently.

A reflecting surface 22*a* of the reflector 22 and a reflecting surface 26*a* of the reflector 26 have a larger area than the reflecting part 100*a* of the light deflector 100. This can reduce the size of the light deflector 100. The lamp unit 10 configured as described above can be used in a variable light distribution headlamp that can be turned on or off in part.

[Light Deflector]

Figure 5A:
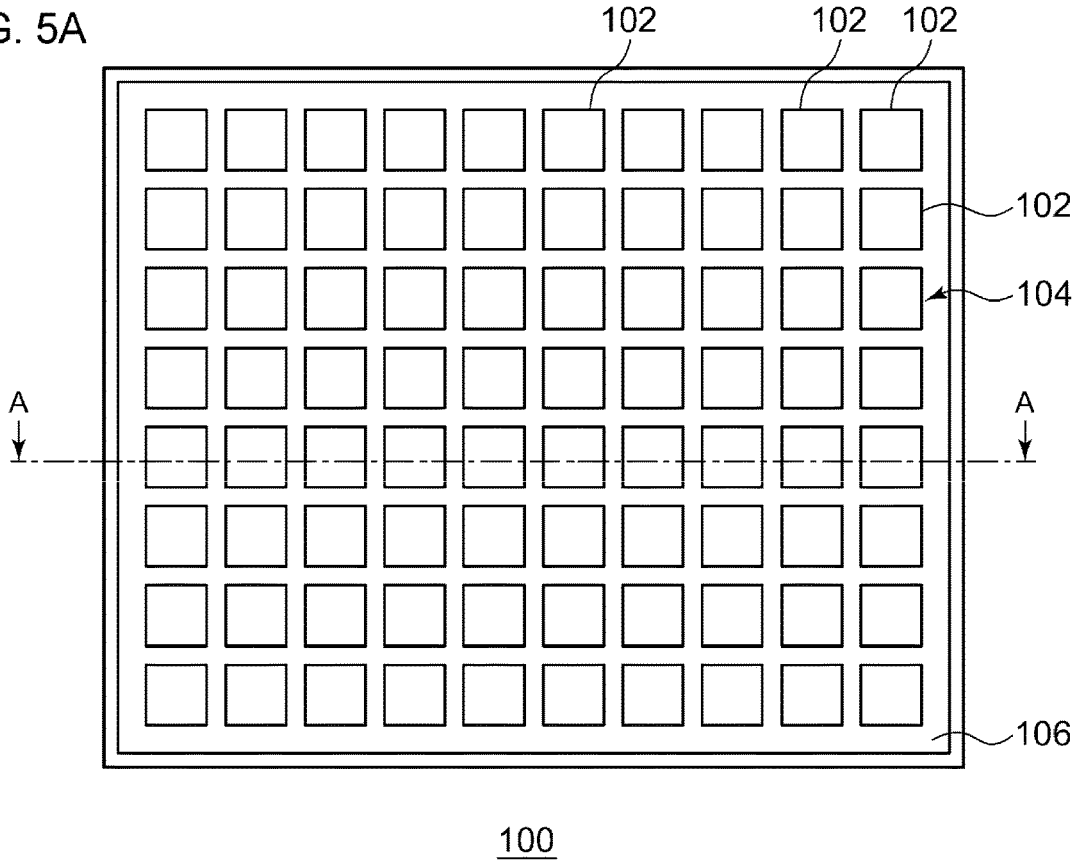
FIG. 5A is a front view showing a schematic configuration of the light deflector according to the embodiment.
Figure 5B:
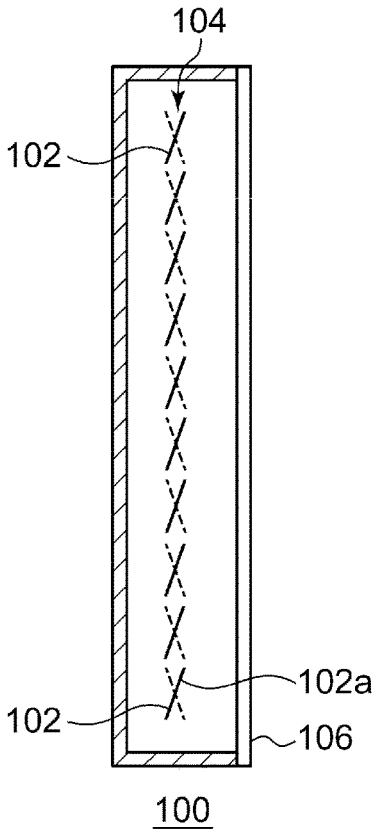
FIG. 5B is an A-A cross-sectional view of the light deflector shown in FIG. 5A.

FIG. 5A is a front view showing a schematic configuration of the light deflector according to the embodiment, and FIG. 5B is an A-A cross-sectional view of the light deflector shown in FIG. 5A.

As shown in FIG. 5A, the light deflector 100 according to the embodiment includes a micromirror array 104 in which a plurality of fine mirror elements 102 are arranged in a matrix, and a transparent cover member 106 provided in front of reflecting surfaces 102*a* of the mirror elements 102 (to the right of the light deflector 100 shown in FIG. 5B). For example, the cover member is made of glass, plastic, etc.

Each mirror element 102 of the micromirror array 104 can be switched between a reflecting position P1 (the position indicated by the solid line shown in FIG. 5B) at which the mirror element 102 reflects the light output from the light source 20 of the first irradiating optical system 16 toward the projective optical system such that the reflected light is effectively used as part of a desired light distribution pattern and a reflecting position P2 (the position indicated by the broken line shown in FIG. 5B) at which the mirror element 102 reflects the light output from the light source such that the reflected light is not effectively used.

Figure 6A:
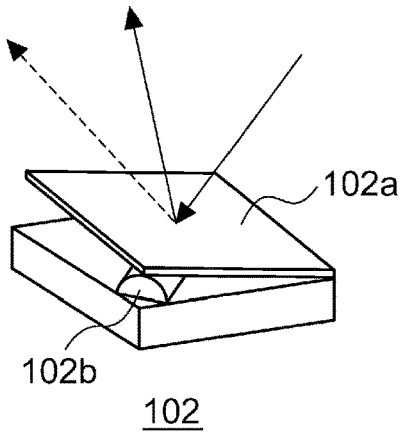
FIG. 6A is a schematic diagram showing how the mirror element reflects the light output from the light source of the first irradiating optical system at the reflecting position P1.
Figure 6B:
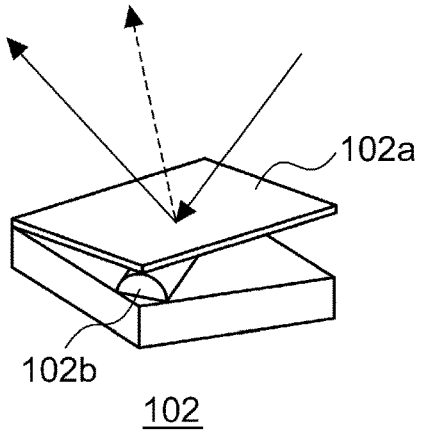
FIG. 6B is a schematic diagram showing how the mirror element reflects the light output from the light source of the first irradiating optical system at the reflecting position P2.
Figure 6C:
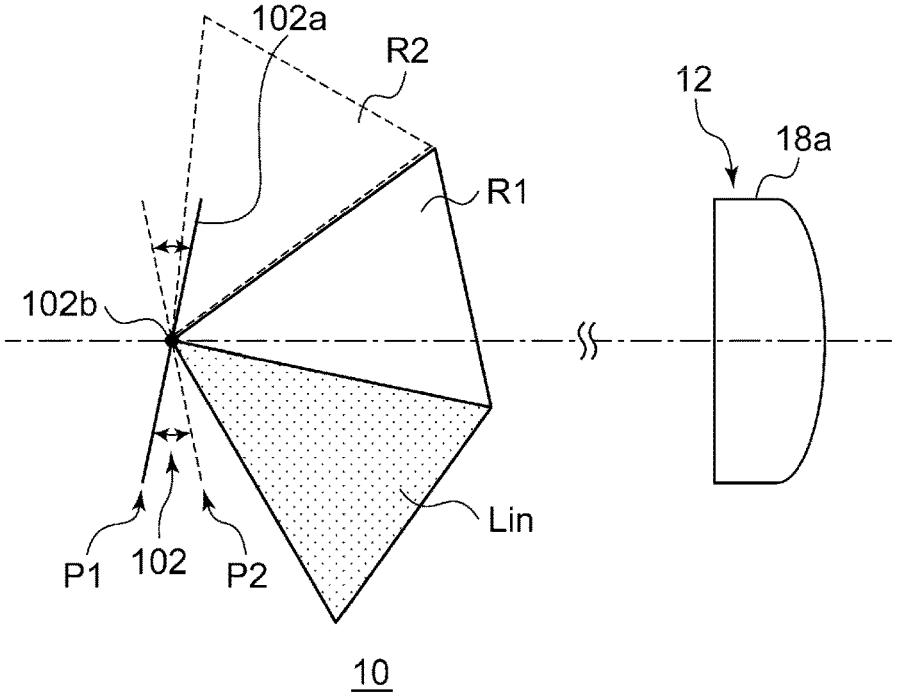
FIG. 6C is a schematic diagram showing how the light output from the light source of the first irradiating optical system is spread when reflected by the mirror element at the first reflecting position P1 and the second reflecting position P2.

FIG. 6A is a schematic diagram showing how the mirror element 102 reflects the light output from the light source 20 of the first irradiating optical system 16 at the reflecting position P1, FIG. 6B is a schematic diagram showing how the mirror element 102 reflects the light output from the light source 20 of the first irradiating optical system 16 at the reflecting position P2, and FIG. 6C is a schematic diagram showing how the light output from the light source 20 of the first irradiating optical system 16 is spread when reflected by the mirror element at the first reflecting position P1 and the second reflecting position P2. For brevity of the description, FIGS. 6A-6C illustrate the micromirror array as being replaced by one mirror element.

As shown in FIG. 6C, the incident light Lin is not a completely parallel light because the light output from the light source 20 is condensed and reflected by the reflector 22. In other words, the incident light Lin incident on the reflecting surface 102*a* of the mirror element 102 has a certain angular spread. The mirror element 102 is arranged such that the reflected light R1 produced by the reflection of the incident light Lin at the reflecting position P1 mainly travels toward the projection lens 18*a* (18*b*). Further, as shown in FIG. 6C, the mirror element 102 is arranged such that the reflected light R2 produced by the reflection of the incident light Lin at the reflecting position P2 does not travel toward the projection lens 18*a*.

A desired projected image, a desired reflected image, and the first light distribution pattern can be obtained by controlling the reflecting position of each mirror element 102 to selectively change the direction of reflection of the light output from the light source 20.

The lamp unit 10 according to the embodiment is provided with the second irradiating optical system 17 in addition to the first irradiating optical system 16.

Figure 7A:
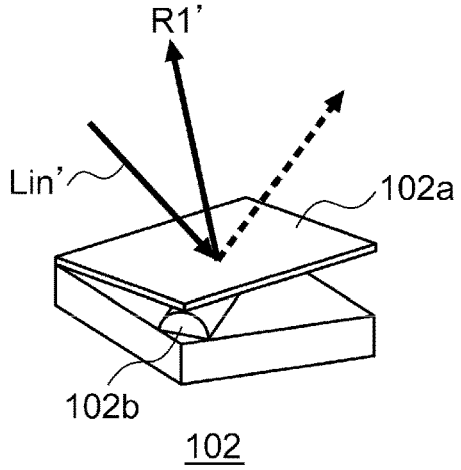
FIG. 7A is a schematic diagram showing how the mirror element reflects the light output from the light source of the second irradiating optical system at the reflecting position P2.
Figure 7B:
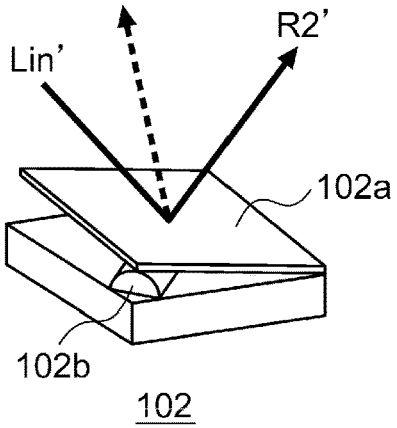
FIG. 7B is a schematic diagram showing how the mirror element reflects the light output from the light source of the second irradiating optical system at the reflecting position P1.
Figure 7C:
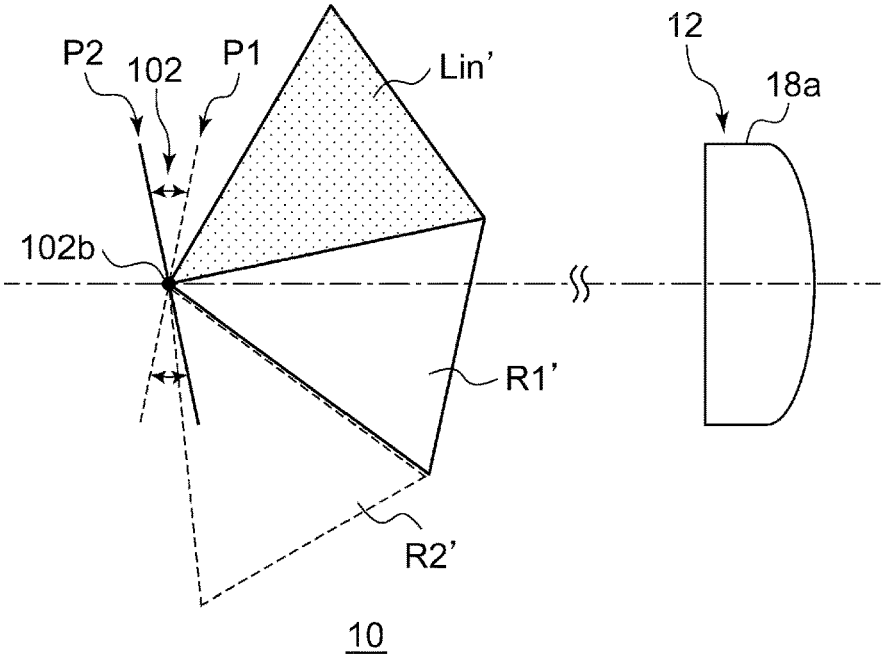
FIG. 7C is a schematic diagram showing how the light output from the light source of the second irradiating optical system is spread when reflected by the mirror element at the first reflecting position P1 and the second reflecting position P2.

FIG. 7A is a schematic diagram showing how the mirror element 102 reflects the light output from the light source 24 of the second irradiating optical system 17 at the reflecting position P2, FIG. 7B is a schematic diagram showing how the mirror element 102 reflects the light output from the light source 24 of the second irradiating optical system 17 at the reflecting position P1, and FIG. 7C is a schematic diagram showing how the light output from the light source 24 of the second irradiating optical system 17 is spread when reflected by the mirror element at the first reflecting position P1 and the second reflecting position P2.

As shown in FIG. 7C, the incident light Lin' is not a completely parallel light because the light output from the light source 24 is condensed and reflected by the reflector 26. In other words, the incident light Lin' incident on the reflecting surface 102*a* of the mirror element 102 has a certain angular spread. The mirror element 102 is arranged such that the reflected light R1' resulting from the reflection of the incident light Lin' at the reflecting position P2 mainly travels toward the projection lens 18*a* (18*b*). Further, as shown in FIG. 7C, the mirror element 102 is arranged such that the reflected light R2' resulting from the reflection of the incident light Lin' at the reflecting position P1 does not travel toward the projection lens 18*a*.

A desired projected image, a desired reflected image, and the second light distribution pattern can be obtained by controlling the reflecting position of each mirror element 102 to selectively change the direction of reflection of the light output from the light source 24.

Thus, the light deflector 100 according to the embodiment is configured such that at least some of the mirror elements 102 of the reflecting part 100*a* can be switched, around a pivot shaft 102*b*, between i) the reflecting position P1 or the reflecting position P2 that are the first reflecting position that reflects the light radiated by the irradiating optical system 16 or the irradiating optical system 17 toward the projective optical system 12 such that the reflected light is effectively used as part of a desired light distribution pattern and ii) the reflecting position P2 or the reflecting position P1 that are the second reflecting position that reflects the light radiated by the irradiating optical system 16 or the irradiating optical system 17 such that the reflected light is not effectively used.

Figure 8:
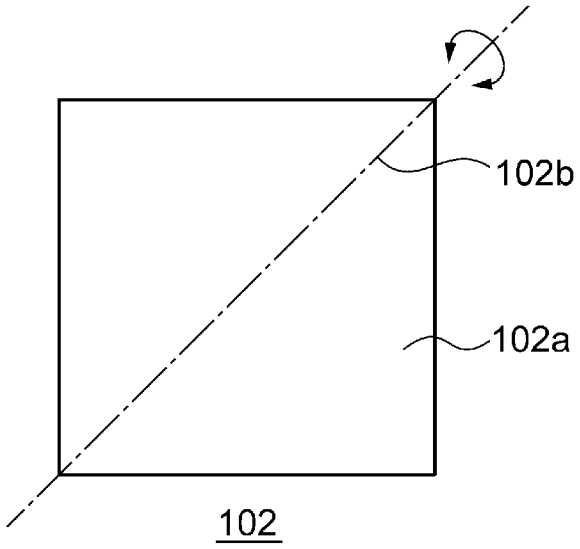
FIG. 8 is a schematic diagram showing the pivot shaft of the mirror element according to the embodiment.

FIG. 8 is a schematic diagram showing the pivot shaft of the mirror element 102 according to the embodiment. The mirror element 102 has the quadrangular (e.g., square, rhombic, rectangular, parallelogram) reflecting surface 102*a*. Each mirror element 102 is configured such that it can be switched between the reflecting position P1 and the reflecting position P2 around the pivot shaft 102*b* aligned with the diagonal line of the quadrangular reflecting surface 102*a*. This allows light distribution patterns of various shapes to be formed promptly and accurately. The pivot shaft 102*b* of the mirror element 102 according to the embodiment extends in the vertical direction. Further, the mirror element 102 according to the embodiment is configured to be displaced about ±10-±20° between the reflecting position P1 and the reflecting position P2 around the pivot shaft 102*b*.

By using the light deflector 100 in which the mirror elements 102 as described above are arranged in a matrix, a plurality of functions characterized by different light distribution patterns can be realized in the single lamp unit 10. For example, as shown in FIG. 6C, a desired light distribution characteristic can be realized by causing each mirror element 102 of the light deflector 100 to reflect the incident light Lin output from the first irradiating optical system 16 toward the projective optical system 12. Meanwhile, as shown in FIG. 7C, a desired light distribution characteristic can be realized by causing each mirror element 102 of the light deflector 100 to reflect the incident light Lin' output from the second irradiating optical system 17 toward the projective optical system 12.

In the case of a lamp unit in which the direction of reflection and the direction of transmittance of a plurality of irradiating optical systems are controlled by a single light deflector, on the other hand, stray light may be produced if another irradiating optical system is located in a region traveled by the reflected light R2 or the reflected light R2' of the respective irradiating optical systems. It is therefore desired to arrange each irradiating optical system in a region that does not overlap (interfere with) a region traveled by the reflected light R2 or the reflected light R2' as much as possible.

By arranging the first irradiating optical system 16 and the second irradiating optical system 17 such that the direction of irradiation by the first light radiated by the first irradiating optical system 16 is opposite (parallel) to the direction of irradiation by the second light radiated by the second irradiating optical system 17 when the front of the reflecting part 100*a* is viewed, however, the second irradiating optical system 17 will be located in the region of the reflected light R2 and the first irradiating optical system 16 will be located in the region of the reflected light R2', as shown in FIG. 6C and FIG. 7C.

It is therefore necessary to adjust the direction or spread of the light radiated by the first irradiating optical system 16 and the second irradiating optical system 17 to prevent such a situation. More specifically, it is necessary to reduce the angular spread of the incident light Lin and the incident light Lin' to a certain degree or shift the regions in which the reflected light R1 and the reflected light R1' are incident on the first projection lens 18*a*.

Figure 9A:
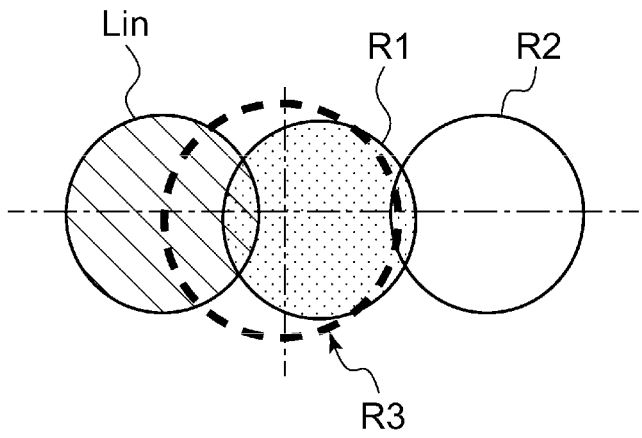
FIG. 9A is a front view schematically showing a relationship between the incident light Lin from the first irradiating optical system, the reflected light R1, and the reflected light R2.
Figure 9B:
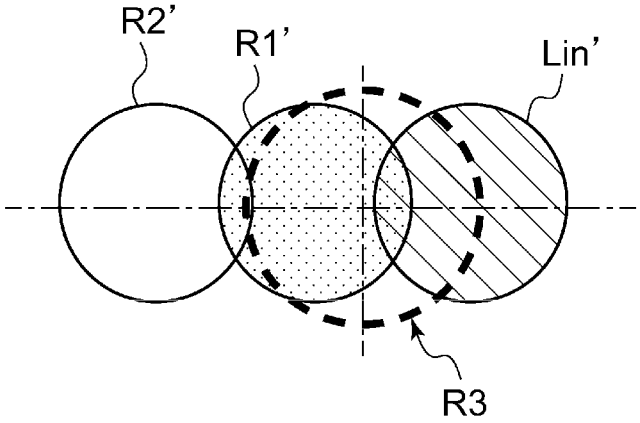
FIG. 9B is a front view schematically showing a relationship between the incident light Lin' from the second irradiating optical system, the reflected light R1', and the reflected light R2'.
Figure 9C:
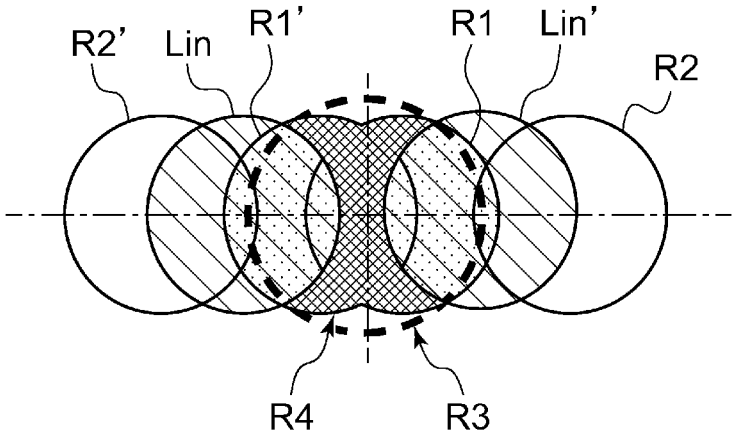
FIG. 9C is a front view schematically showing how the states of FIG. 9A and FIG. 9B are superimposed.

FIG. 9A is a front view schematically showing a relationship between the incident light Lin from the first irradiating optical system 16, the reflected light R1, and the reflected light R2, FIG. 9B is a front view schematically showing a relationship between the incident light Lin' from the second irradiating optical system 17, the reflected light R1', and the reflected light R2', and FIG. 9C is a front view schematically showing how the states of FIG. 9A and FIG. 9B are superimposed.

As shown in FIG. 9A, the reflected light R1 from the first irradiating optical system 16 is incident on the right side of the effective region R3 of the projective optical system 12. The effective region R3 is a region in which the light contributing to the light distribution formed in front of the lamp unit 10 is transmitted. Further, as shown in FIG. 9B, the reflected light R1' from the second irradiating optical system 17 is incident on the left side of the effective region R3 of the projective optical system 12. Therefore, the effective region R4 of the output light that results when both the first irradiating optical system 16 and the second irradiating optical system 17 are taken into consideration is limited to the central portion of the effective region R3 of the projective optical system 12 as shown in FIG. 9C. Further improvements are necessary from the perspective of using the light output from the light source efficiently.

In this background, we have arranged the first irradiating optical system 16 and the second irradiating optical system 17 such that the direction of irradiation by the incident light Lin and the direction of irradiation by the incident light Lin' are not parallel when the front of the reflecting part 100*a* is viewed.

Figure 10A:
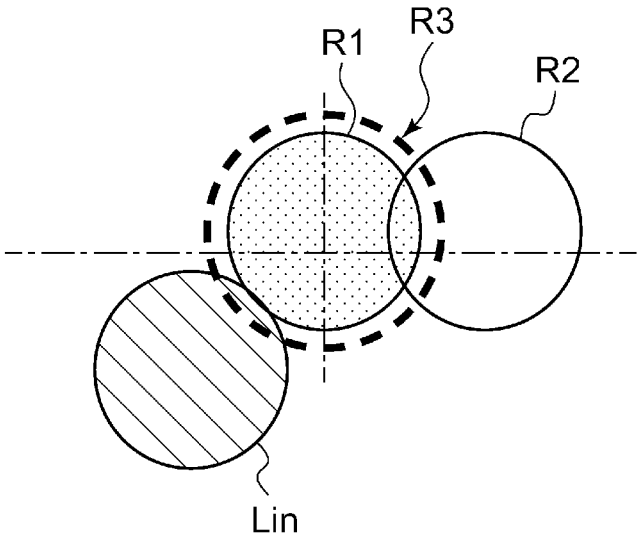
FIG. 10A is a front view schematically showing a relationship according to the embodiment between the incident light Lin from the first irradiating optical system, the reflected light R1, and the reflected light R2.
Figure 10B:
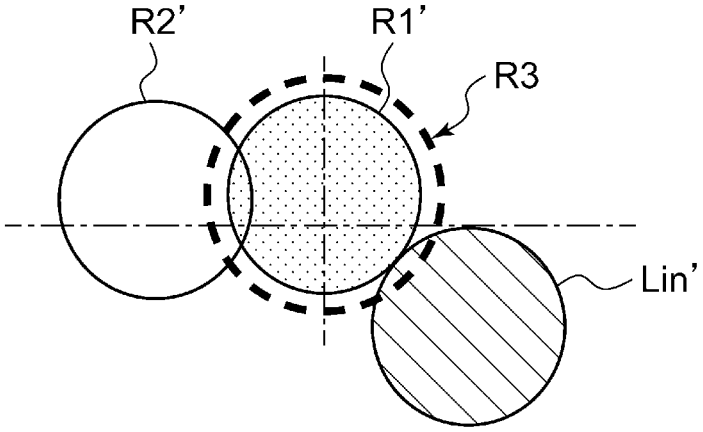
FIG. 10B is a front view schematically showing a relationship according to the embodiment between the incident light Lin' from the second irradiating optical system, the reflected light R1', and the reflected light R2'.
Figure 10C:
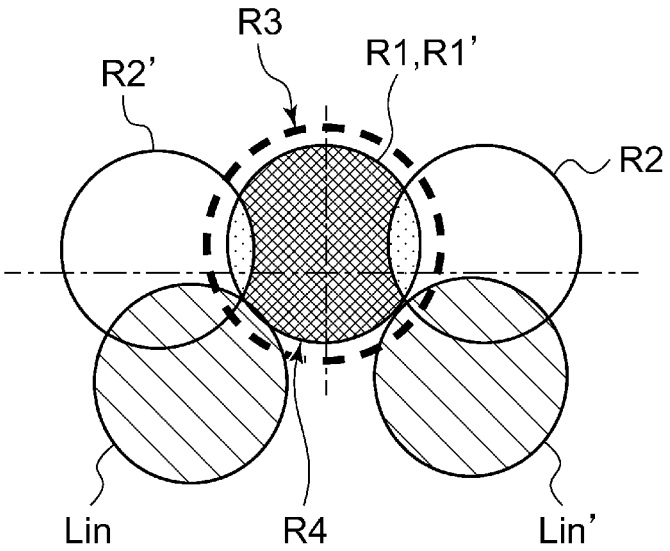
FIG. 10C is a front view schematically showing how the states of FIG. 10A and FIG. 10B are superimposed.

FIG. 10A is a front view schematically showing a relationship according to the embodiment between the incident light Lin from the first irradiating optical system 16, the reflected light R1, and the reflected light R2, FIG. 10B is a front view schematically showing a relationship according to the embodiment between the incident light Lin' from the second irradiating optical system 17, the reflected light R1', and the reflected light R2', and FIG. 10C is a front view schematically showing how the states of FIG. 10A and FIG. 10B are superimposed.

As shown in FIGS. 1 through 4, the first irradiating optical system 16 according to the embodiment is provided on one side of the pivot shaft 102*b* (the leftward region in FIG. 3) when the front of the reflecting part 100*a* is viewed and is arranged to irradiate the reflecting part 100*a* with the incident light Lin from diagonally below when the front of the reflecting part 100*a* is viewed. The second irradiating optical system 17 is provided on the other side of the pivot shaft 102*b* when the front of the reflecting part 100*a* is viewed and is arranged to irradiate the reflecting part 100*a* with the incident light Lin' from diagonally below when the front of the reflecting part 100*a* is viewed.

As shown in FIG. 10A, the reflected light R1 from the first irradiating optical system 16 is incident on the center of the effective region R3 of the projective optical system 12. Further, as shown in FIG. 10B, the reflected light R1' from the second irradiating optical system 17 is incident on the center of the effective region R3 of the projective optical system 12. Therefore, the effective region R4 of the output light that results when both the first irradiating optical system 16 and the second irradiating optical system 17 are taken into consideration represents most of the effective region R3 of the projective optical system 12, which shows that the light output from the light source is efficiently used.

In the lamp unit 10 according to the embodiment, the angle of incidence of the center of the incident light Lin and the incident light Lin' on the reflecting part 100*a* (front view) is in the range of 30-40° below (or above) the horizontal plane. Further, the angle of incidence of the center of the incident light Lin and the incident light Lin' on the reflecting part 100*a* (top view) is in the range of 30-40° with respect to the plane that includes the surface of the reflecting part 100*a*. This can reduce the width of the lamp unit 10.

As described above, the first irradiating optical system 16 and the second irradiating optical system 17 of the lamp unit 10 according to the embodiment can be provided separately on both sides of the light deflector 100. Accordingly, the incidence direction of the light traveling toward the reflecting part 100*a* of the light deflector 100 can be properly set without considering the interference between the irradiating optical systems.

This inhibits the reflected light R2 that is not reflected toward the projective optical system 12 when the incident light Lin radiated by the first irradiating optical system 16 is reflected by the light deflector 100 from interfering with the second irradiating optical system 17. Similarly, the reflected light R2' that is not reflected toward the projective optical system 12 when the incident light Lin' radiated by the second irradiating optical system 17 is reflected by the light deflector 100 is inhibited from interfering with the first irradiating optical system 16. This increases the flexibility of arrangement and configuration of the irradiating optical systems and makes it possible to use more of the light radiated by the respective irradiating optical systems in the projective optical system.

Further, the light deflector 100 is configured such that the reflected light R2 produced by the reflection of the incident light Lin at the reflecting position P2 and the reflected light R2' produced by the reflection of the incident light Lin' at the reflecting position P1 are not incident on the projection lens 18*a*. This inhibits occurrence of stray light.

A description is given above of a case in which two irradiating optical systems (light sources) are provided. Alternatively, three or more irradiating optical systems may be provided.

The embodiments of the present invention are not limited to those described above and appropriate combinations or replacements of the features of the embodiments are also encompassed by the present invention. The embodiments may be modified by way of combinations, rearranging of the processing sequence, design changes, etc., based on the knowledge of a skilled person, and such modifications are also within the scope of the present invention.

What is claimed is:

1. A lamp unit comprising:

a projective optical system;

a light deflector that is provided behind the projective optical system and selectively reflects incident light toward the projective optical system;

a first irradiating optical system that irradiates a reflecting part of the light deflector with first light; and a second irradiating optical system that irradiates the reflecting part of the light deflector with second light, wherein the first irradiating optical system and the second irradiating optical system are arranged such that a direction of irradiation by the first light and a direction of irradiation by the second light are not parallel when a front of the reflecting part is viewed, wherein the light deflector is configured such that at least a partial region of the reflecting part is adapted to be switched, around a pivot shaft, between i) a first reflecting position that reflects light radiated by the first irradiating optical system or the second irradiating optical system toward the projective optical system such that reflected light is effectively used as part of a light distribution pattern and ii) a second reflecting position that reflects light radiated by the first irradiating optical system or the second irradiating optical system such that reflected light is not effectively used, the first irradiating optical system is provided on one side of the pivot shaft when a front of the reflecting part is viewed, and the second irradiating optical system is provided on the other side of the pivot shaft when the front of the reflecting part is viewed.

2. The lamp unit according to claim 1, wherein the first irradiating optical system is arranged to irradiate the reflecting part diagonally with the first light when the front of the reflecting part is viewed, and the second irradiating optical system is arranged to irradiate the reflecting part diagonally with the second light when the front of the reflecting part is viewed.

3. The lamp unit according to claim 2, wherein the first irradiating optical system is arranged such that an angle of incidence of the first light on the reflecting part is in a range of 30-40° below or above a horizontal plane when the front of the reflecting part is viewed.

4. The lamp unit according to claim 1, wherein the light deflector includes a micromirror array.

5. The lamp unit according to claim 1, wherein the projective optical system includes a projection lens, and the light deflector is configured such that the first light and the second light reflected at the second reflecting position are not incident on the projection lens.

6. The lamp unit according to claim 1, wherein the first irradiating optical system includes a reflector configured to focus reflected light on the reflecting part of the light deflector.

7. The lamp unit according to claim 6, wherein a reflecting surface of the reflector has a larger area than the reflecting part of the light deflector.

* * * * *